US005632659A

United States Patent [19]

Martin et al.

[11] Patent Number: 5,632,659

[45] Date of Patent: May 27, 1997

[54] COMBUSTION CHAMBER DRAIN SYSTEM

[75] Inventors: Shawn K. Martin; William A. Garnett, both of Panama City Beach; William W. McCrory, Panama City, all of Fla.

[73] Assignee: The United States of America as represented by the Secretary of the Navy, Washington, D.C.

[21] Appl. No.: 604,143

[22] Filed: Feb. 20, 1996

[51] Int. Cl.[6] ..... B63H 21/14

[52] U.S. Cl. ..... 440/88; 181/118; 123/198 D

[58] Field of Search ..... 440/88, 89; 123/661, 123/198 D, DIG. 2; 181/110, 118

[56] References Cited

U.S. PATENT DOCUMENTS 4,007,804 2/1977 Hardison ..... 181/118

4,820,213 4/1989 Holtermann ..... 440/88

*Primary Examiner*—Jesus D. Sotelo

*Attorney, Agent, or Firm*—Harvey A. Gilbert

[57] ABSTRACT

An apparatus for quickly and virtually complete purging of seawater from the combustion chambers of an outboard engine that has been submerged or a submersible outboard engine. A poppet valve is incorporated in the combustion chamber portion of the engine head. The valve has discharge ports radially disposed around its periphery so that when the poppet valve is pneumatically operated, the ports permit the discharge of entrapped water from the combustion chamber as the engine is turned over.

8 Claims, 2 Drawing Sheets

COMBUSTION CHAMBER DRAIN SYSTEM

INTRODUCTION

The present invention relates to submersible outboard engines and in particular to a combustion chamber drain system for quickly and completely purging seawater from said chamber.

BACKGROUND OF THE INVENTION

Submersible engines presently in use intake seawater by various means. Quick and virtually complete elimination of such water from the engine combustion chamber is obviously highly desirable to preserve engine performance and structural integrity. Most important in military and emergency applications is the need to return the engine to full operational condition at the earliest possible time. Presently, submersible engines remove entrapped water from their combustion chambers by forcing the water past the piston rings. This is a time consuming process that can be damaging to the pistons, the piston rings, and the connecting rods. The degree to which entrapped water removal is successful is always in question when removal is dependent upon the water being forced past the piston rings.

SUMMARY OF THE INVENTION

It is thus an object of the present invention to provide a system for fast and complete removal of seawater entrapped in a submersible outboard engine.

It is yet an another object of the present invention to provide a system for removing entrapped seawater from the combustion chamber of a submersible outboard engine without the seawater having to be moved passed the piston rings.

It is still another object of the present invention to provide a system for elimination of entrapped seawater from the combustion chamber of a submersible outboard engine through a quick-release high pressure drain valve connected to a port in the engine cylinder head.

It is finally another object of the present invention to provide a system for elimination of entrapped seawater from the combustion chamber of a submersible outboard engine through a quick-release poppet-like valve.

These and other objects, features, and advantages will be more clearly understood when the following detailed description is considered in conjunction with the accompanying drawings.

DETAILED DESCRIPTION OF THE INVENTION

Figure 1:
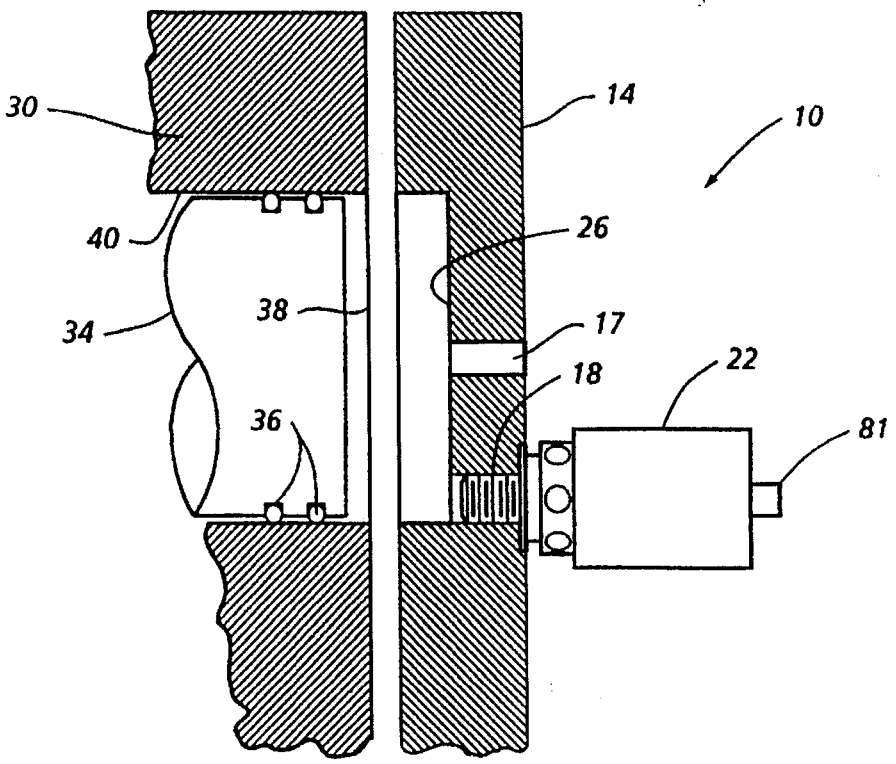
FIG. 1 is a sectional view of the invention.

Referring to FIG. 1, the present invention, the combustion chamber drain system 10 consists of the modified cylinder head 14 which has the spark plug or ignition source port 17, the poppet valve boss 18, the drain valve 22, and the combustion chamber portion 26.

The modified cylinder head 14 connects by means of bolts (not shown) to the engine block 30 so that the combustion chamber portion 26 of the head 14 mates with the combustion chamber portion 38 of the engine block 30. The piston 34 is encircled by the piston rings 36 for sealing the piston 34 to the wall 40 of the combustion chamber.

Figure 3:
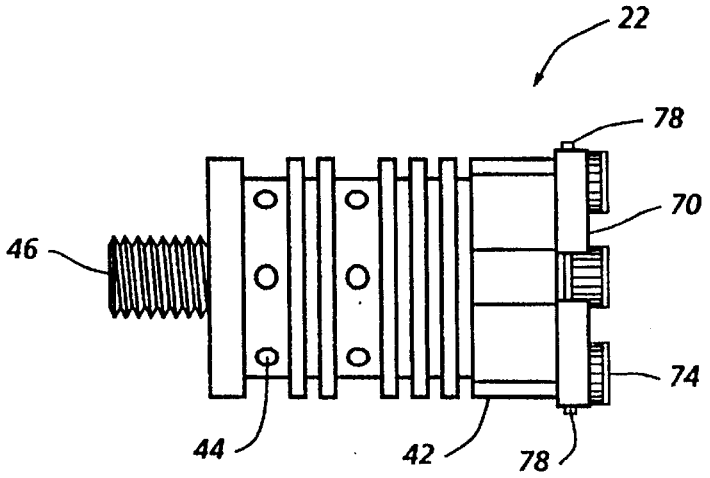
FIG. 3 is a side view of the assembled poppet valve.
Figure 2:
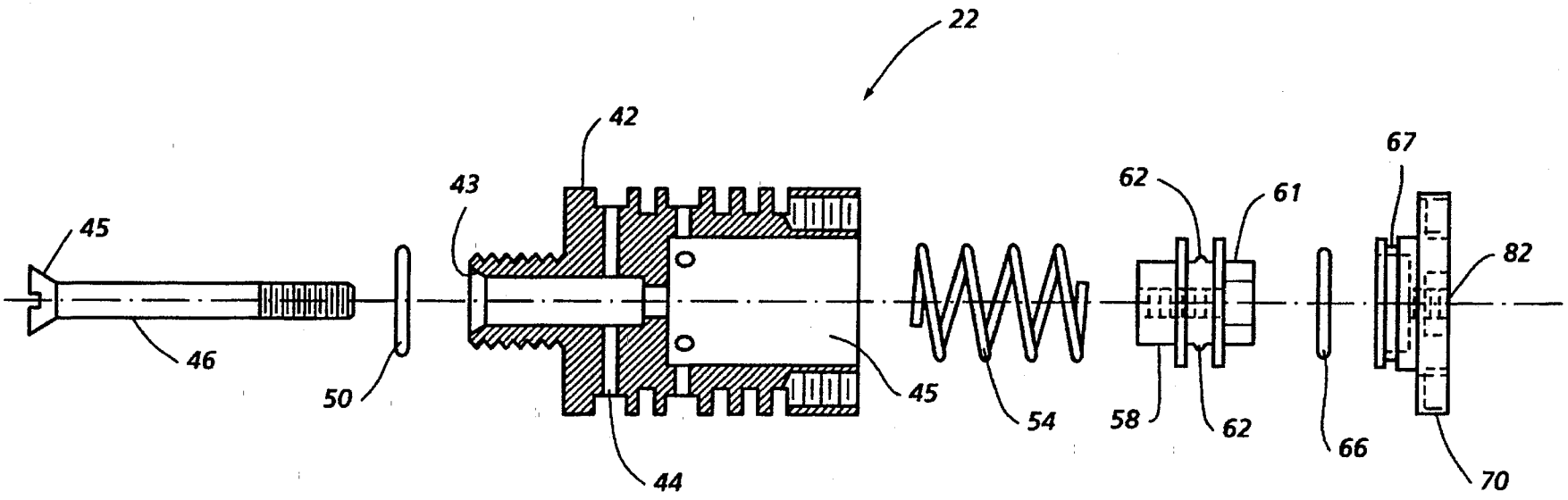
FIG. 2 is an exploded view of the poppet valve used in the invention.

The drain valve 22 is a high pressure poppet style valve. See FIGS. 2 and 3. In FIG. 2, the drain valve 22 is shown consisting of the valve body 42 which receives the poppet 46. The "O" ring 50 sits in the "O" ring groove or neck 67 in the end cap 70. It seals the valve body 42 to the cylinder head 14. The valve body 42 has a lapped seal 43 to the surface 45 of the poppet 46. The valve body 42 contains the symmetrically spaced discharge ports 44 about its circumference. Upon insertion of the poppet 46 into the valve body 42, the spring 54 is caused to encircle the poppet 46 and compressed by the piston 58 which engages the threaded end of the poppet 46. The piston 58 has the "U"-shaped one-way low pressure packing seal 62 encircling it about the intermediate neck 64. The "O" ring 66 encircles the end cap 70 about the neck 67. The end cap 70 engages the hexhead end 61 of the piston 58 which engages and compresses the spring 54 into the cavity 45 in the valve body 42. The end cap 70 is then secured to the valve body 42 by means of the cap screws 74, shown in FIG. 3, extending through the end cap 70, through the lock washers 78, and into the valve body 42. The pressure range for poppet valve selection is, of course, related to the performance specifications of the engine with which it is to be used. The "O" ring seals are selected for engine temperature and automotive or marine environments.

During actual use the high pressure poppet style drain valve 22 is threaded into the modified cylinder head 14. Assuming the engine is submerged and the combustion chambers take on water, the combustion chamber drain system 10 can be operated as soon as the engine emerges from and remains above the water surface. A compressed-air nipple 81 is threaded into the air port 82 and compressed air is introduced to force the piston 58 against the spring 54 overcoming the force it maintains to keep the poppet 46 seated at the lapped seal 43. This causes the poppet to move away from its seat sealing the valve body 42 from the engine combustion chamber portion 26. Once the compressed air is applied and the poppet 46 unseals the valve 22, the engine is turned over enough times to fully eliminate any trapped water and to permit the introduction of fresh combustion chamber and piston seal lubrication. Thereafter, the engine is in condition to be started. The engine may be turned over by various means including pneumatic or hydraulic. In a preferred embodiment, the means was a hydraulic motor.

The structure and method disclosed herein illustrate the principles of the present invention. The invention may be embodied in other specific forms without departing from its spirit or essential characteristics. The embodiment of the invention described herein is to be considered in all respects as exemplary and illustrative rather than restrictive. Therefore, the appended claims rather than the foregoing description define the scope of the invention. All modifications to the embodiment described herein that come within the meaning and range of equivalence of the claims are embraced within the scope of the invention.

What we now claim as our invention is:

1. A combustion chamber drain system for elimination of water trapped in the combustion chamber of an internal combustion engine having a block, said system comprising:

means for sealing off the engine block to permit combustion in said engine, said means having one combustion chamber portion aligned to join with an opposite combustion chamber portion in said block to create a complete and functional combustion chamber, and having one threaded hole extending through said means to receive a threaded sparkplug, and a second adjacent threaded hole extending through said means to provide a passage between the combustion chamber portion therein and the environment external to said engine;

threaded means for preventing exhaust gas discharge from said engine during engine operation and for providing a sealable passage for releasing water trapped in said engine after said engine is flooded and removed from a flooding environment, said means threadably inserted into said second threaded hole of said block sealing means;

means for operating said engine without combustion therein in order to remove said trapped water through said sealable passage; and means for powering said preventing and releasing means.

2. The system of claim 1 wherein said means for powering said preventing and releasing means is a pneumatic supply.

3. The system of claim 2 wherein said pneumatic supply is compressed air.

4. The system of claim 1 wherein said means for preventing exhaust gas discharge and for releasing trapped water is a high pressure poppet style drain valve having a poppet seated in the body of said valve at one end to seal said valve during engine operation and a port at an opposite end to receive pressurized fluid for operating said drain valve by unseating said poppet and discharging said trapped water.

5. The system of claim 1 wherein said means for sealing off said engine block is an engine head.

6. The system of claim 1 wherein said means for operating said engine without combustion is an engine starter.

7. The system of claim 6 wherein said engine starter is a hydraulic motor.

8. A combustion chamber drain system for elimination of water trapped in the combustion chamber of an internal combustion engine having a block, said system, comprising:

an engine head having one combustion chamber portion aligned to join with an opposite combustion chamber portion in said block to create a complete and functional combustion chamber, and having a threaded port extending through said head to receive a threaded sparkplug, and a second adjacent threaded port extending through said head to provide a passage between the combustion chamber portion therein and the environment external to said engine;

a threaded high-pressure poppet-style drain valve for preventing exhaust gas discharge from said engine during engine operation and for releasing water trapped in said engine after said engine is flooded and removed from a flooding environment, said drain valve threadably inserted into the threaded hole of said head;

an engine cranking apparatus for operating said engine without combustion therein; and a means for powering said drain valve to permit discharge of combustion chamber entrapped water therethrough as said engine is cranked.

* * * * *